US006699333B1

(12) United States Patent
Dubois

(10) Patent No.: US 6,699,333 B1
(45) Date of Patent: Mar. 2, 2004

(54) CASE HARDENED STEEL WITH HIGH TEMPERING TEMPERATURE, METHOD FOR OBTAINING SAME AND PARTS FORMED WITH SAID STEEL

(75) Inventor: Philippe Dubois, Quincy Sous Senart (FR)

(73) Assignee: Aubert & Duval, Paris (FR)

( * ) Notice: Subject to any disclaimer, the term of this patent is extended or adjusted under 35 U.S.C. 154(b) by 0 days.

(21) Appl. No.: 09/720,927

(22) PCT Filed: Jun. 28, 1999

(86) PCT No.: PCT/FR99/01543

§ 371 (c)(1),
(2), (4) Date: Feb. 26, 2001

(87) PCT Pub. No.: WO00/00658

PCT Pub. Date: Jan. 6, 2000

(30) Foreign Application Priority Data

Jun. 29, 1998 (FR) ..... 98 08247

(51) Int. Cl.[7] ..... C22C 38/44; C22C 38/42; C22C 38/46

(52) U.S. Cl. ..... 148/319; 148/233

(58) Field of Search ..... 148/319, 233

(56) References Cited

U.S. PATENT DOCUMENTS

| | | | |
|---|---|---|---|
| 3,110,798 | A | 11/1963 | Keay |
| 3,362,811 | A | 1/1968 | Heuschkel |
| 3,661,565 | A | 5/1972 | Harvey |

FOREIGN PATENT DOCUMENTS

| | | | |
|---|---|---|---|
| DE | 19 05 247 | | 5/1970 |
| EP | 0 236 505 | | 9/1987 |
| FR | 1 489 566 | | 10/1967 |
| FR | 2 166 585 | | 8/1973 |
| GB | 1 172 672 | | 12/1969 |
| JP | 09271806 | * | 10/1997 |
| SU | 425 968 | | 10/1974 |
| SU | 516 727 | | 11/1977 |

* cited by examiner

*Primary Examiner*—Sikyin Ip
(74) *Attorney, Agent, or Firm*—Amster, Rothstein & Ebenstein

(57) ABSTRACT

The invention discloses a carburizing steel composition comprising, by weight:

0.06% to 0.18% of C;
0.5% to 1.5% of Si;
0.2% to 1.5% of Cr;
1% to 3.5% of Ni;
1.1% to 3.5% of Mo;
and, if appropriate:
at most 1.6% of Mn; and/or
at most 0.4% of V; and/or
at most 2% of Cu; and/or
at most 4% of Co;
the complement being constituted by iron and residual impurities;
the amounts of Ni, Mn, Cu, Co, Cr, Mo and V in said composition, expressed by weight, satisfying the following relationships:

$$2.5 \leqq Ni+Mn+1.5Cu+0.5Co \leqq 5 \quad (1)$$

$$2.4 \leqq Cr+Mo+V \leqq 3.7 \quad (2)$$

and a process for producing carburized and treated parts produced from the compositions.

12 Claims, 7 Drawing Sheets

CASE HARDENED STEEL WITH HIGH TEMPERING TEMPERATURE, METHOD FOR OBTAINING SAME AND PARTS FORMED WITH SAID STEEL

CROSS-REFERENCE TO RELATED APPLICATION

This is the national phase of PCT Application No. PCT/FR99/01543, International Filing Date of Jun. 28, 1999, published in French.

The present invention relates to a carburizing steel composition, to parts formed from said steel, and to a process for producing parts formed from said steel.

Carburizing is a thermochemical surface treatment which generally produces parts combining good core ductility with a "case-hardened" carburized surface that is hard and resistant to wear.

Many applications require a steel with a good resistance to softening at working temperatures. Examples that can be cited are gear wheels, bearings and transmission shafts for helicopters or for vehicles for motor racing, gear wheels, camshafts and other parts used in engine distribution systems, fuel injectors and compressors.

The following particular carburizing steels are routinely used for such applications: 17CrNiMo6, 16NiCr6, 14NiCr12, 10NiCrMo13, 16NiCrMo13 or 17NiCrMo17. Such steels can be used up to working temperatures of close to 130° C., but the carburized layer has neither a resistance to softening nor an elevated temperature hardness sufficient for working temperatures exceeding 190° C.

U.S. Pat. No. 3,713,905, granted to T. V. Philip and R. L. Vedder on Jan. 30$^{th}$, 1973, describes the properties obtained for a steel with the following chemical composition as a percentage by weight:

0.07%–0.8% of C;

at most 1% of Mn;

0.5%–2% of Si;

0.5%–1.5% of Cr;

2%–5% of Ni;

0.65%–4% of Cu;

0.25%–1.5% of Mo;

at most 0.5% of V;

the complement being iron.

The tensile strength and the impact strength obtained with that steel are compatible with the envisaged applications, but the tempering properties and the elevated temperature hardness of the carburized layer are insufficient for the applications cited above and for working temperatures of up to 220° C.

U.S. Pat. No. 4,157,258, granted to T. V. Philip and R. L. Vedder on Jun. 5$^{th}$ 1979, describes a steel with the following chemical composition as a percentage by weight:

0.06%–0.16% of C;

0.2%–0.7% of Mn;

0.5%–1.5% of Si;

0.5%–1.5% of Cr;

1.5%–3% of Ni;

1%–4% of Cu;

2.5%–4% of Mo;

≦0.4% of V;

≦0.05% of P;

≦0.05% of S;

≦0.03% of N;

≦0.25% of Al;

≦0.25% of Nb;

≦0.25% of Ti;

≦0.25% of Zr;

≦0.25% of Ca the complement being iron.

The compromise between tensile strength and impact strength for that steel is good. The carburized layer allows a tempering temperature of up to about 260° C. The maximum working temperature is about 230° C.

However, none of the prior art carburizing steel compositions can allow a tempering temperature for the carburized layer of up to 350° C. to be used, nor do they provide good elevated temperature hardness for working temperatures of up to 280° C. while preserving satisfactory core characteristics.

There is currently a need for such steels in a number of fields. As an example, regarding the manufacture of gear parts for helicopters, regulations require that a helicopter must be capable of functioning for thirty minutes after losing oil from its transmission following an incident. That requirement assumes that the materials used to manufacture the gears have been tempered at a minimum temperature of about 280° C.

In the field of engines, designers tend to increase the working temperature of engine parts and its connected equipment such as gearboxes, in order to increase yields and/or to simplify heat extraction circuits. Depending on the location of the parts in this equipment, working temperatures can reach 280° C., imposing a minimum tempering temperature of 330° C. to guarantee that properties are stable during use.

The present invention aims to provide a carburizing steel composition that has all of the characteristics mentioned above.

In a first aspect, the invention provides a carburizing steel composition comprising, by weight:

0.06% to 0.18% of C;

0.5% to 1.5% of Si;

0.2% to 1.5% of Cr;

1% to 3.5% of Ni;

1.1% to 3.5% of Mo;

and, if appropriate:

at most 1.6% of Mn; and/or at most 0.4% of V; and/or at most 2% of Cu; and/or at most 4% of Co;

the complement being constituted by iron and residual impurities;

the weight contents of Ni, Mn, Cu, Co, Cr, Mo and V in said composition, expressed by weight, satisfying the following relationships:

$$2.5 \leqq Ni+Mn+1.5Cu+0.5Co \leqq 5 \quad (1)$$

$$2.4 \leqq Cr+Mo+V \leqq 3.7 \quad (2).$$

Preferably, the sulfur content is limited to 0.010% and the phosphorous content is limited to 0.020% by weight, for applications in the upper part of the range, but higher contents are acceptable for other applications, provided that they do not cause a reduction in the ductility, toughness and fatigue strength properties of the steel.

The amount of elements such as aluminum, cerium, titanium, zirconium, calcium or niobium, which act either to deoxidize or to refine grain size, is preferably limited to 0.1% by weight each.

Regarding the principal elements of the composition, in general it has been shown that low carbon, silicon, molybdenum, chromium, and vanadium contents, and high manganese, nickel, cobalt, and copper contents can improve the ductility and toughness of the steel.

In contrast, high carbon, silicon, molybdenum, chromium, and vanadium contents and low manganese, nickel, cobalt, and copper contents can improve the tempering strength of the steel.

The essential role of carbon is to contribute to producing hardness, tensile strength, and hardenability. For carbon contents of less than 0.06% by weight, the hardness and tensile strength obtained in the core of carburized and treated parts are insufficient.

In practice, the desired minimum tensile strength is about 1000 MPa, i.e., about 320 VH (Vickers hardness). The higher the carbon content, the greater the hardness, tensile strength and hardenability but, at the same time, the impact strength and toughness decrease. For this reason, the carbon content is limited to a maximum of 0.18% by weight.

The most important range for the compromise between tensile strength and toughness is 0.09%–0.16% by weight of carbon. However, the ranges 0.06%–0.12% and 0.12%–0.18% are also of interest for applications requiring different core hardnesses.

Silicon provides a major contribution to the tempering strength of this steel and its minimum content is 0.5% by weight. In order to avoid the formation of delta ferrite and to retain sufficient toughness, the silicon content is limited to a maximum of 1.5% by weight. The optimum range is 0.7%–1.3% by weight, but the range 1.3%–1.5% is also of interest.

Chromium contributes to core hardenability and to good tempering strength of the carburized layer, and its minimum content is 0.2% by weight. To avoid embrittlement of the carburized layer by an excess of interlaced carbides, the chromium content must be limited to a maximum of 1.5% by weight. The optimum range is 0.5%–1.2%, but ranges of 0.2%–0.8% and 0.8%–1.5% are also of interest.

The role of molybdenum is identical to that of chromium, and it can keep the elevated temperature hardness high, in particular by forming intragranular carbides in the carburized layer. Its minimum content is 1.1% by weight. However, its embrittling effect on this steel limits its maximum content to 3.5% by weight. The optimum range is 1.5%–2.5%, but ranges of 1.1%–2.3% and 2.3%–3.5% are also of interest.

Vanadium contributes to limiting enlargement of the grain during the carburizing cycles and treatment cycles used. Because of its embrittling effect and its influence on ferrite formation, its content must be limited to a maximum value of 0.4% by weight. The optimum range is 0.15%–0.35%, but ranges of 0.05%–0.25% and 0.25%–0.4% are also of interest.

Manganese, nickel and copper are gamma-forming elements necessary for equilibrating the chemical composition, avoiding ferrite formation and limiting the temperature of the $\alpha/\gamma$ transformation points. They also provide a major contribution to increasing hardenability, impact strength and toughness but in too high a content, they deteriorate the tempering strength, the elevated temperature hardness and the wear resistance and increase the quantity of residual austenite in the carburized layer.

For these reasons, the manganese content is limited to a maximum of 1.6% by weight. The optimum range is 0.2%–0.7% by weight, but the range 0.7%–1.5% is also of interest. Similarly, the nickel content is limited to the range 1%–3.5% by weight, the optimum range is 2%–3%, but the ranges 1%–2% and 2%–3.5% are also of interest. Finally, copper is limited to a maximum of 2% by weight, the optimum range is 0.3%–1.1% but the range 1.1%–2% can also be of interest.

Cobalt contributes to the tempering strength of the steel and can reduce the AC point. Its effect is substantially the same for low contents. Large quantities of this gamma-forming element stabilizes the residual austenite in the carburized layer. The maximum limit is 4% by weight; contents of less than 1.5% by weight are recommended.

In a second aspect, the invention provides a process for producing carburized and treated parts comprising the following operations:

a. constituting a charge for producing a composition in accordance with the present invention, as described above;

b. melting said charge in an arc furnace;

c. re-heating and thermomechanical transformation of the ingot;

d. homogenizing heat treatment of the structure and refinement of the grain;

e. carburizing; and f. final heat treatment.

The steel of the invention can be obtained using conventional production techniques but, to obtain the best results as regards impact strength, toughness and fatigue strength, it is recommended that consumable electrode remelting is carried out, either with a slurry (ESR) or under reduced pressure (VAR), following arc furnace melting.

To further enhance this performance, it is also possible to carry out a first melting step by induction under reduced pressure (VIM) and to continue with consumable electrode remelting.

The ingots obtained by one of the above methods undergo re-heating at temperatures of about 1100° C. to homogenize the structure, followed by thermomechanical transformations aimed at endowing the product produced from this alloy with a sufficient forging ratio or 3 or more (step c) of the process of the invention). Lower forging ratios can be used, however, for large parts. Conventional processes, such as rolling, forging, drop forging or drawing, are used for these thermomechanical transformations.

A number of implementations can be envisaged regarding step d) of the process of the invention. The transformed products can simply be softened at a temperature below the critical point ($AC_1$), or tempered at a temperature that is above the critical temperature ($AC_1$), assuming a sufficiently slow onset of cooling.

When the best possible characteristics are required, it is preferable, however, to carry out normalization from a temperature above the critical point ($AC_3$), followed by air cooling and softening tempering at a temperature below the critical point ($AC_1$).

By way of indication, the ($AC_1$) critical point temperature is generally in the range from 700° C. to 800° C., while the ($AC_3$) critical point temperature is generally in the range from 900° C. to 980° C.

Carburizing, step e) of the process of the invention, can be carried out using conventional means, the carburizing cycle being defined by the skilled person depending on the desired hardening depth, in conventional manner. A low pressure process can in particular be used.

Regarding step f), the final heat treatment of the part, a variety of implementations can be envisaged. It is possible to move directly from the carburizing temperature to the austenitization temperature, then to quench the parts, but it is preferable to allow the parts to cool to ambient temperature after carburizing, then to re-heat to the austenitization temperature, above the critical point ($AC_3$) before quenching them. By way of indication, the austenitization temperature range is 900° C.–1050° C.

The best characteristics of tensile strength, impact strength, core toughness and superficial hardness of the carburized layer are obtained by carrying out an oil quench after austenitization, but a good compromise between these same characteristics can be achieved by carrying out a gas quench which has the advantage of reducing deformation of the parts during this operation and thus minimizing subsequent machining.

In order to obtain maximum hardness for the carburized layer, and for impact strength and toughness of the sub-layer, it is preferable to temper at the lowest possible temperature compatible with the working temperature. More particularly, a difference of 50° C. between the tempering temperature and the working temperature is preferred, the tempering temperature possibly being up to 350° C.

When producing this steel in large quantities, a continuous casting technique can be employed to reduce production costs, but a reduction in ductility, impact strength and toughness in particular must be expected.

In a third aspect, the invention provides carburized and treated parts formed from the carburizing steel of the invention which, at ambient temperature, has a core hardness of close to 320 VH to 460 VH, an ISO V impact strength of at least 50 Joules, and more particularly 70 to 150 Joules, a toughness of close to 100 MPa√m, a superficial carburized layer hardness of close to 750 VH, and which, at 250° C., has a superficial carburized layer hardness of close to 650 VH. These parts can advantageously be produced using the production process of the invention, but also using any other process selected as a function of the final application.

The following examples demonstrate that a combination of the elements carbon, manganese, silicon, chromium, nickel, molybdenum, vanadium, copper and cobalt, in the proportions by weight indicated above, results in a steel with, simultaneously, excellent hardness, tensile strength, impact strength, impact strength transition and core toughness characteristics, associated with excellent tempering strength and excellent carburized layer elevated temperature hardness up to working temperatures of 280° C.

EXAMPLES

The symbols used have the following meanings:

$R_m$=maximum strength;

$R_{p0.2}$=conventional yield strength at 0.2% deformation;

$E_{5d}$=elongation in % over a 5 d base (d=sample diameter);

Z=reduction in area;

VH=Vickers hardness;

RCH=Rockwell hardness;

KV=energy at break, V-notch pendulum impact test.

The examples are supplemented by the figures in the accompanying drawings, in which.

Example No 1

A 35 kg ingot was produced with the chemical composition shown below, as a percentage by weight, in accordance with the present invention:

| | |
|---|---|
| C | 0.15% |
| Si | 1.11% |
| Mn | 0.43% |
| Cr | 0.92% |
| Ni | 2.51% |
| Mo | 1.96% |
| V | 0.28% |

The remainder was constituted by iron and residual impurities.

This ingot was produced by arc melting, then homogenizing at high temperature to produce a uniform structure, then it was forged. The forged products were slowly oven cooled. They were normalized to dissolve the carbides, homogenize the austenitic structure and refine the grain.

Bars in accordance with the invention were austenitized at 940° C., oil quenched, cooled in a cryogenic vessel regulated to −75° C. then tempered at a temperature of 250° C.

The mechanical characteristics obtained are shown in the following table:

| $R_m$ (MPa) | $R_{p0.2}$ (MPa) | $E_{5d}$ (%) | Z (%) | KV (J) |
|---|---|---|---|---|
| 1427 | 1101 | 13.5 | 60 | 69 |

Other samples of this steel were carburized using a low pressure process at a temperature of about 900° C. for 8 hours, then austenitized at 940° C., cooled in a cryogenic vessel regulated to −75° C. and finally tempered at temperatures in the range 150° C. to 350° C.

The superficial hardness of the carburized layer and the core hardness obtained for different tempering temperatures are shown in the following table:

| Tempering temperature (° C.) | 150 | 200 | 250 | 300 | 350 |
|---|---|---|---|---|---|
| Surface hardness, VH | 800 | 752 | 751 | 735 | 720 |
| Core hardness, VH | 443 | 438 | 437 | 436 | 437 |

Figure 1:
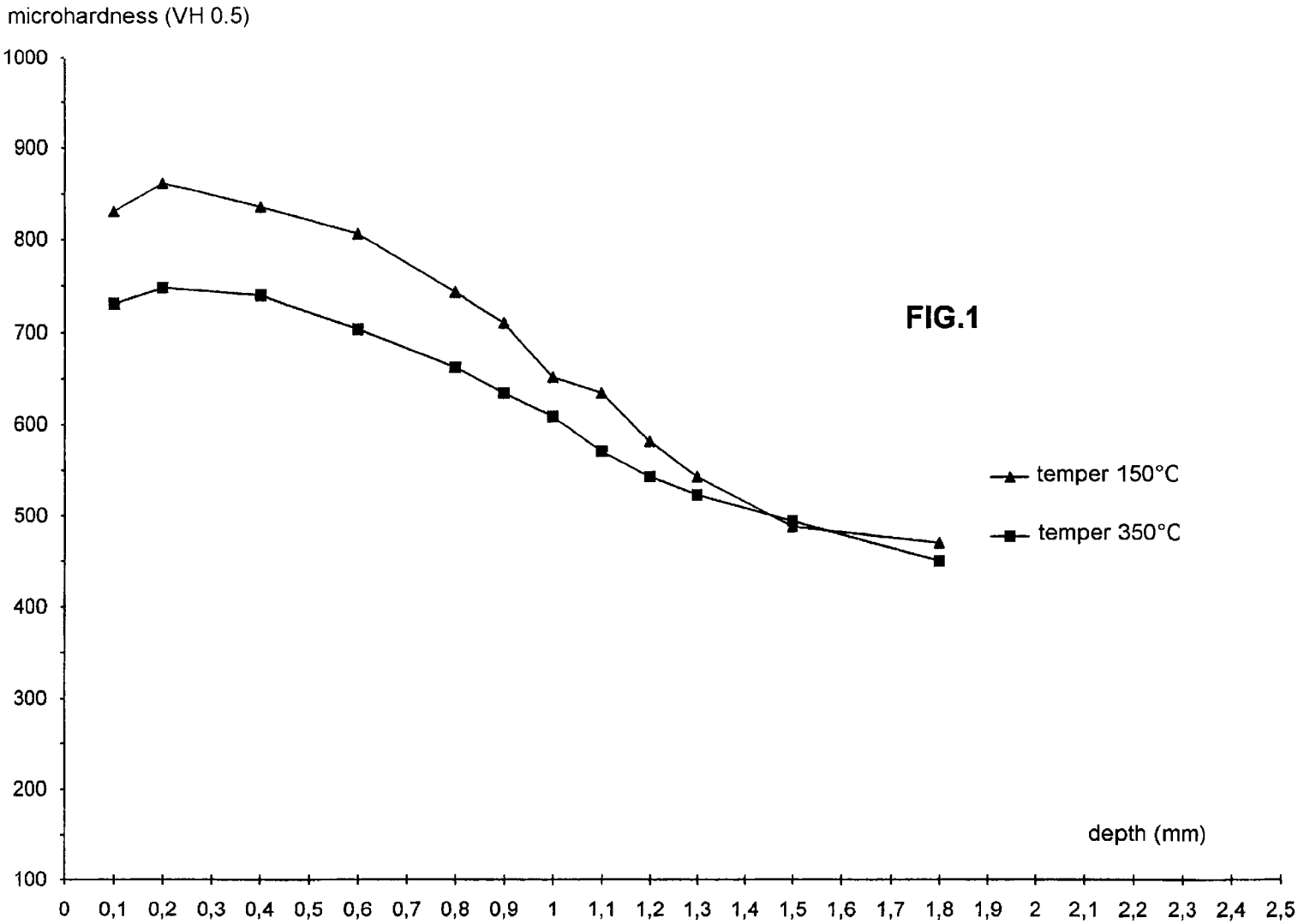
FIG. 1 shows the variation in microhardness as a function of depth for two samples, the preparation of which is described in Example 1.

Hardness measurements were also carried out on polished sections to determine the hardness gradient in the carburized layer. FIG. 1 shows the results obtained for tempering temperatures of 150° C. and 350° C.

Example No 2

A 35 kg ingot was produced with the chemical composition shown below, as a percentage by weight, in accordance with the present invention:

| | |
|---|---|
| C | 0.146% |
| Si | 1.12% |
| Mn | 1% |
| Cr | 0.92% |

-continued

| | |
|---|---|
| Ni | 1.54% |
| Mo | 1.97% |
| V | 0.284% |

The remainder was constituted by iron and residual impurities.

This ingot was produced by arc melting, then homogenizing at high temperature to produce a uniform structure, then it was forged. The forged products were slowly oven cooled. They were normalized to dissolve the carbides, homogenize the austenitic structure and refine the grain.

Bars resulting from these treatments were austenitized at 940° C., oil quenched, cooled in a cryogenic vessel regulated to −75° C. then tempered at a temperature of 250° C.

The mechanical characteristics obtained are shown in the following table:

| $R_m$ (MPa) | $R_{p0.2}$ (MPa) | $E_{5d}$ (%) | Z (%) | KV (J) |
|---|---|---|---|---|
| 1415 | 1081 | 13.4 | 57 | 51 |

Other samples of this steel were carburized using a low pressure process at a temperature of about 900° C. for 8 hours, then austenitized at 940° C., cooled in a cryogenic vessel regulated to −75° C. and finally tempered at temperatures in the range 150° C. to 350° C.

The superficial hardness of the carburized layer and the core hardness obtained for different tempering temperatures are shown in the following table:

| Tempering temperature (° C.) | 150 | 200 | 250 | 300 | 350 |
|---|---|---|---|---|---|
| Surface hardness, VH | 835 | 748 | 750 | 734 | 722 |
| Core hardness, VH | 441 | 436 | 435 | 437 | 433 |

Figure 2:
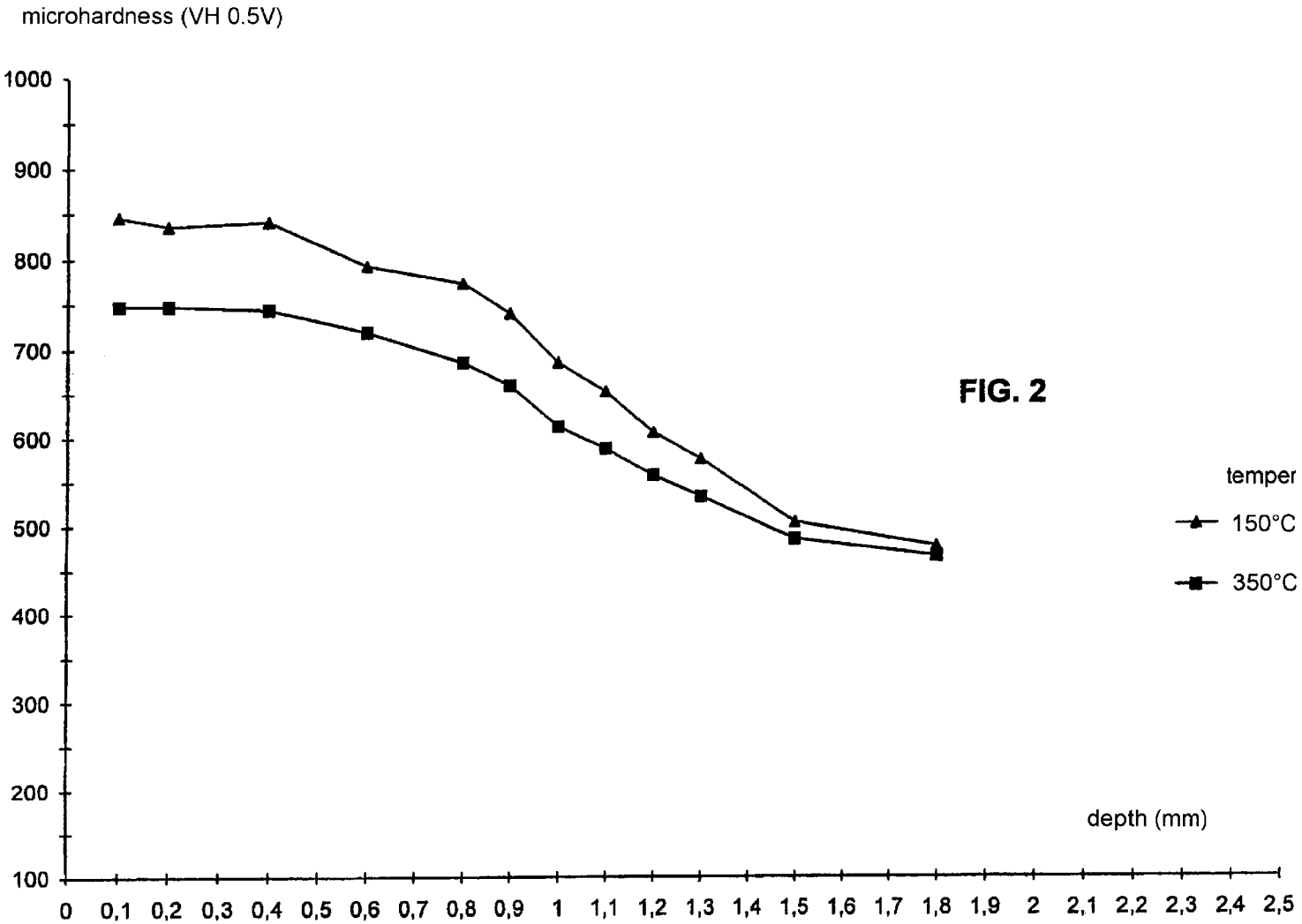
FIG. 2 shows the variation in microhardness as a function of depth for two samples, the preparation of which is described in Example 2.

Hardness measurements were also carried out on polished sections to determine the hardness gradient in the carburized layer. FIG. 2 shows the results obtained for tempering temperatures of 150° C. and 350° C.

Example No 3

A 35 kg ingot was produced with the chemical composition shown below, as a percentage by weight, in accordance with the present invention:

| | |
|---|---|
| C | 0.14% |
| Si | 1.49% |
| Mn | 0.98% |
| Cr | 0.914% |
| Ni | 1.53% |
| Mo | 1.99% |
| V | 0.284% |
| Cu | 0.801% |

The remainder was constituted by iron and residual impurities.

This ingot was produced by arc melting, then homogenizing at high temperature to produce a uniform structure, then it was forged. The forged products were slowly oven cooled. They were normalized to dissolve the carbides, homogenize the austenitic structure and refine the grain.

Bars in accordance with the invention were austenitized at 940° C., oil quenched, cooled in a cryogenic vessel regulated to −75° C. then tempered at a temperature of 250° C.

The mechanical characteristics obtained are shown in the following table:

| $R_m$ (MPa) | $R_{p0.2}$ (MPa) | $E_{5d}$ (%) | Z (%) | KV (J) |
|---|---|---|---|---|
| 1440 | 1136 | 13.2 | 57 | 66 |

Other samples of this steel were carburized using a low pressure process at a temperature of about 900° C. for 8 hours, then austenitized at 940° C., cooled in a cryogenic vessel regulated to −75° C. and finally tempered at temperatures in the range 150° C. to 350° C.

The superficial hardness of the carburized layer and the core hardness obtained for different tempering temperatures are shown in the following table:

| Tempering temperature (° C.) | 150 | 200 | 250 | 300 | 350 |
|---|---|---|---|---|---|
| Surface hardness, VH | 784 | 740 | 740 | 718 | 712 |
| Core hardness, VH | 451 | 440 | 432 | 447 | 438 |

Figure 3:
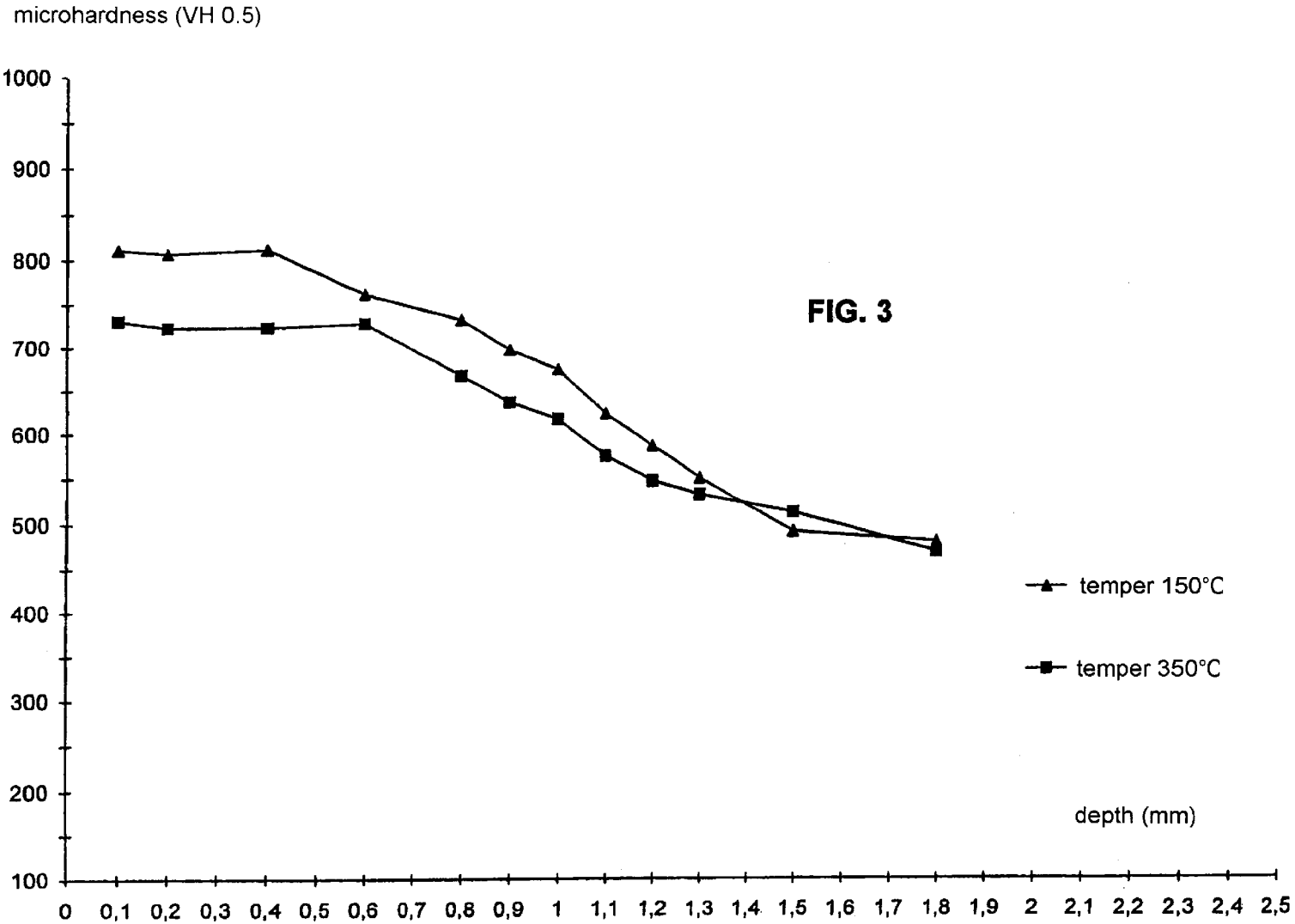
FIG. 3 shows the variation in microhardness as a function of depth for two samples, the preparation of which is described in Example 3.

Hardness measurements were also carried out on polished sections to determine the hardness gradient in the carburized layer. FIG. 3 shows the results obtained for tempering temperatures of 150° C. and 350° C.

Example No 4

A 35 kg ingot was produced with the chemical composition shown below, as a percentage by weight, in accordance with the present invention:

| | |
|---|---|
| C | 0.11% |
| Si | 0.52% |
| Mn | 0.49% |
| Cr | 0.99% |
| Ni | 1.23% |
| Mo | 1.96% |
| Co | 3.96% |

The remainder was constituted by iron and residual impurities.

This ingot was produced by arc melting, then homogenizing at high temperature to produce a uniform structure, then it was forged. The forged products were slowly oven cooled. They were normalized to dissolve the carbides, homogenize the austenitic structure and refine the grain.

Bars resulting from these treatments were austenitized at 940° C., oil quenched, cooled in a cryogenic vessel regulated to −75° C. then tempered at a temperature of 250° C.

The mechanical characteristics obtained are shown in the following table:

| $R_m$ (MPa) | $R_{p0.2}$ (MPa) | $E_{5d}$ (%) | Z (%) | KV (J) |
|---|---|---|---|---|
| 1045 | 801 | 17.5 | 76 | 113 |

Other samples of this steel were carburized using a low pressure process at a temperature of about 900° C. for 8 hours, then austenitized at 940° C., cooled in a cryogenic vessel regulated to −75° C. and finally tempered at temperatures in the range 150° C. to 350° C.

The superficial hardness of the carburized layer and the core hardness obtained for different tempering temperatures are shown in the following table:

| Tempering temperature (° C.) | 150 | 200 | 250 | 300 | 350 |
|---|---|---|---|---|---|
| Surface hardness, VH | 880 | 786 | 749 | 780 | 715 |
| Core hardness, VH | 371 | 381 | 374 | 374 | 367 |

Figure 4:
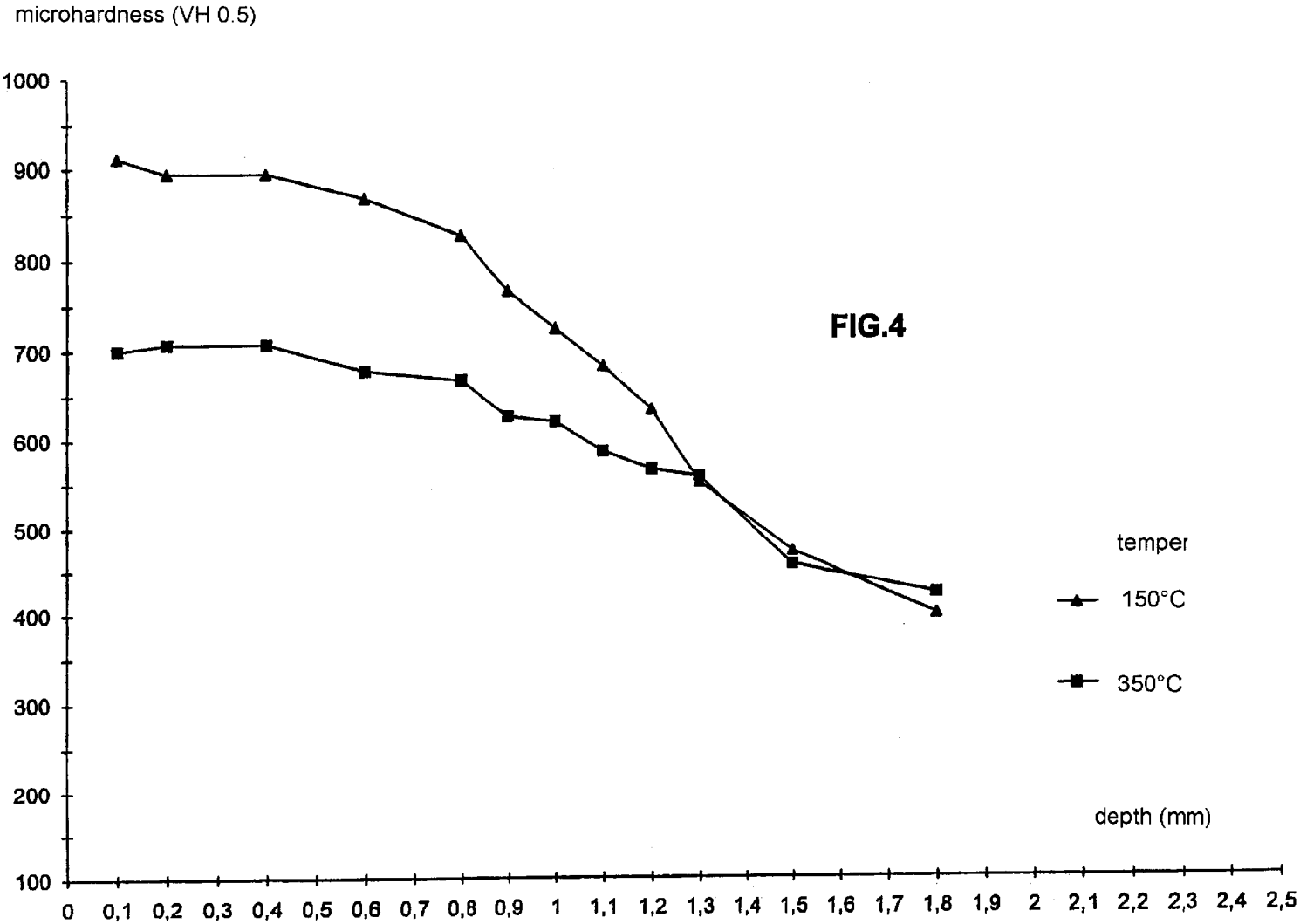
FIG. 4 shows the variation in microhardness as a function of depth for two samples, the preparation of which is described in Example 4.

Hardness measurements were also carried out on polished sections to determine the hardness gradient in the carburized layer. FIG. 4 shows the results obtained for tempering temperatures of 150° C. and 350° C.

Example No 5

A 35 kg ingot was produced with the chemical composition shown below, as a percentage by weight, in accordance with the present invention:

| | |
|---|---|
| C | 0.12% |
| Si | 0.52% |
| Mn | 0.47% |
| Cr | 0.54% |
| Ni | 1.05% |
| Mo | 3% |
| V | 0.01% |

The remainder was constituted by iron and residual impurities.

This ingot was produced by arc melting, then homogenizing at high temperature to produce a uniform structure, then it was forged. The forged products were slowly oven cooled. They were normalized to dissolve the carbides, homogenize the austenitic structure and refine the grain.

Bars resulting from these treatments were austenitized at 960° C., oil quenched, cooled in a cryogenic vessel regulated to −75° C. then tempered at a temperature of 250° C.

The mechanical characteristics obtained are shown in the following table:

| $R_m$ (MPa) | $R_{p0.2}$ (MPa) | $E_{5d}$ (%) | Z (%) | KV (J) |
|---|---|---|---|---|
| 1149 | 879 | 13.6 | 72 | 110 |

Other samples of this steel were carburized using a low pressure process at a temperature of about 900° C. for 8 hours, then austenitized at 960° C., cooled in a cryogenic vessel regulated to −75° C. and finally tempered at temperatures in the range 150° C. to 350° C.

The superficial hardness of the carburized layer and the core hardness obtained for different tempering temperatures are shown in the following table:

| Tempering temperature (° C.) | 150 | 200 | 250 | 300 | 350 |
|---|---|---|---|---|---|
| Surface hardness, VH | 864 | 770 | 716 | 705 | 680 |
| Core hardness, VH | 440 | 434 | 432 | 423 | 423 |

Figure 5:
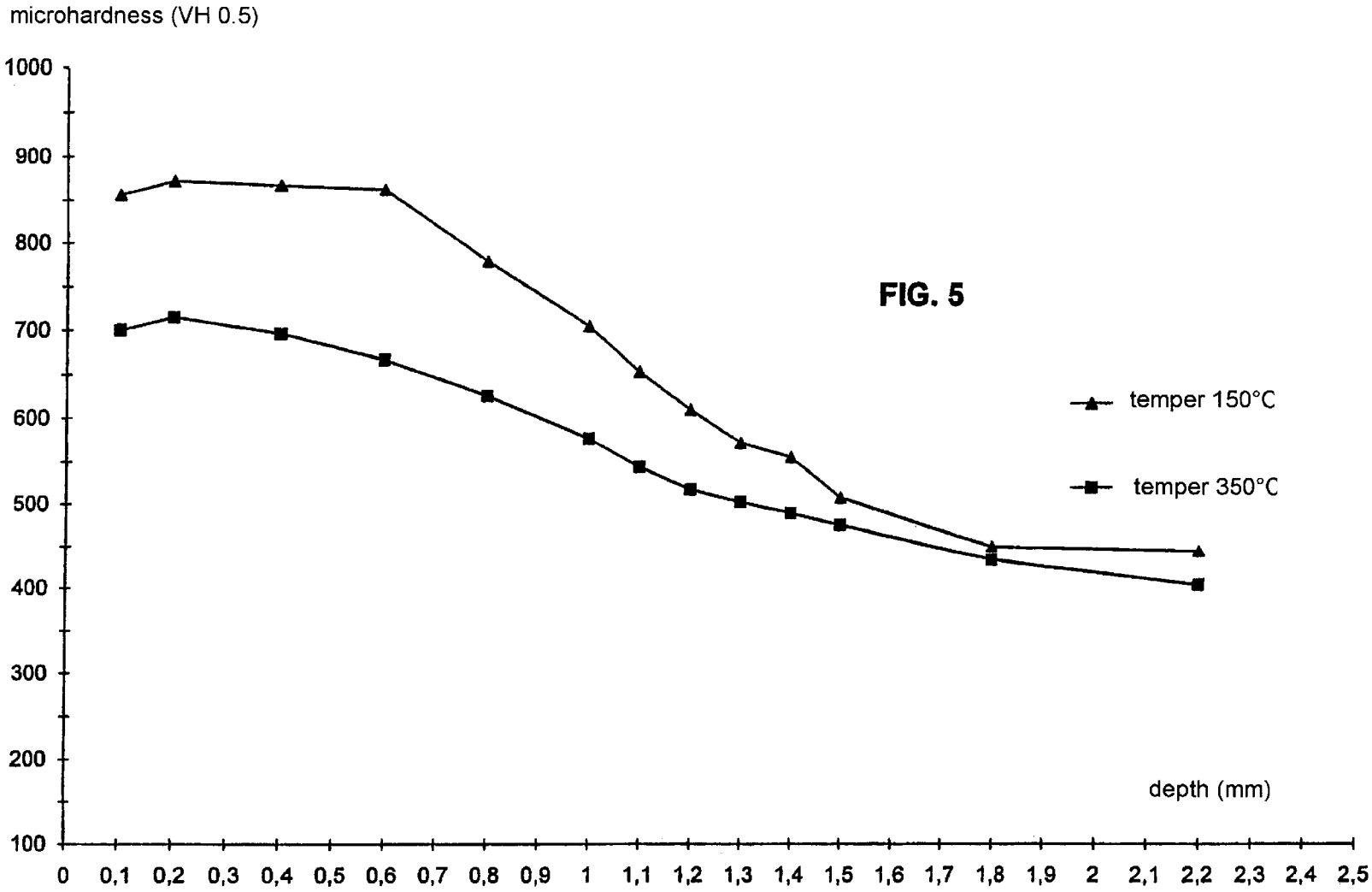
FIG. 5 shows the variation in microhardness as a function of depth for two samples, the preparation of which is described in Example 5.

Hardness measurements were also carried out on polished sections to determine the hardness gradient in the carburized layer. FIG. 5 shows the results obtained for tempering temperatures of 150° C. and 300° C.

Example No 6

A 35 kg ingot was produced with the chemical composition shown below, as a percentage by weight, in accordance with the present invention:

| | |
|---|---|
| C | 0.12% |
| Si | 0.71% |
| Mn | 1.57% |
| Cr | 1.02% |
| Ni | 1.01% |
| Mo | 2.02% |
| V | 0.01% |

The remainder was constituted by iron and residual impurities.

This ingot was produced by arc melting, then homogenizing at high temperature to produce a uniform structure, then it was forged. The forged products were slowly oven cooled. They were normalized to dissolve the carbides, homogenize the austenitic structure and refine the grain.

Bars resulting from these treatments were austenitized at 960° C., oil quenched, cooled in a cryogenic vessel regulated to −75° C. then tempered at a temperature of 250° C.

The mechanical characteristics obtained are shown in the following table:

| $R_m$ (MPa) | $R_{p\ 0.2}$ (MPa) | $E_{5d}$ (%) | Z (%) | KV (J) |
|---|---|---|---|---|
| 1258 | 1009 | 12.3 | 71 | 120 |

Other samples of this steel were carburized using a low pressure process at a temperature of about 900° C. for 8 hours, then austenitized at 960° C., cooled in a cryogenic vessel regulated to −75° C. and finally tempered at temperatures in the range 150° C. to 350° C.

The superficial hardness of the carburized layer and the core hardness obtained for different tempering temperatures are shown in the following table:

| Tempering temperature (° C.) | 150 | 200 | 250 | 300 | 350 |
|---|---|---|---|---|---|
| Surface hardness, VH | 828 | 779 | 754 | 730 | 702 |
| Core hardness, VH | 441 | 438 | 438 | 439 | 439 |

Figure 6:
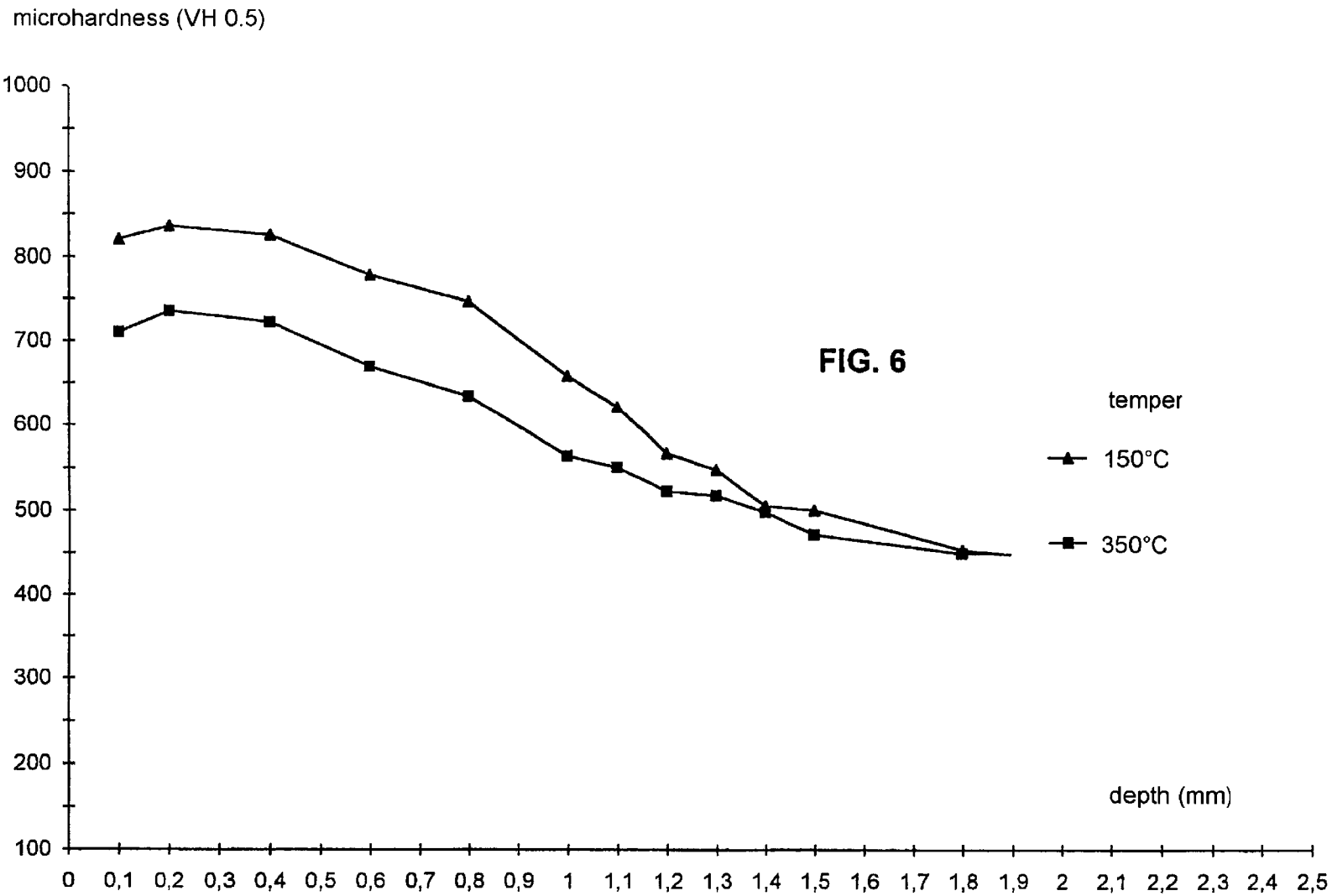
FIG. 6 shows the variation in microhardness as a function of depth for two samples, the preparation of which is described in Example 6.

Hardness measurements were also carried out on polished sections to determine the hardness gradient in the carburized layer. FIG. 6 shows the results obtained for tempering temperatures of 150° C. and 300° C. Example No 7

A 1000 kg ingot was produced with the chemical composition shown below, as a percentage by weight, in accordance with the present invention:

| | |
|---|---|
| C | 0.14% |
| Si | 1.12% |
| Mn | 0.44% |
| Cr | 0.95% |
| Ni | 2.52% |
| Mo | 1.93% |
| V | 0.27% |
| Cu | 0.88% |

The remainder was constituted by iron and residual impurities.

This ingot was produced by vacuum induction melting (VIM), then by consumable electrode remelting, and then re-heated at high temperature to homogenize the structure. It was then rolled to produce 90 mm diameter cylindrical rods. These rods underwent a normalization treatment to dissolve the carbides, homogenize the austenitic structure and refine the grain.

Samples from these rods were carburized using a low pressure process at a temperature of about 900° C. for 8 hours; samples for characterizing the core properties underwent an identical thermal cycle but in a neutral atmosphere so that the chemical composition was not modified.

All of the samples were austenitized at 940° C., oil quenched, cooled in a cryogenic vessel regulated to −75° C. then tempered at a temperature of 300° C.

The mechanical characteristics obtained are shown in the following table:

| Tempering temperature (° C.) | $R_m$ (MPa) | $R_{p\,0.2}$ (MPa) | $E_{5d}$ (%) | Z (%) | KV (J) |
|---|---|---|---|---|---|
| 300 | 1430 | 1111 | 13 | 59 | 75 |

The test carried out in accordance with American standard ASTM E 399-90 on a 20 mm thick CT type sample resulted in a toughness $K_Q$ of 107 MPa√m.

The development of the superficial hardness of the carburized layer as a function of the tempering temperature is shown in the table below:

| Tempering temperature (° C.) | 150 | 200 | 250 | 300 | 350 |
|---|---|---|---|---|---|
| Hardness, VH | 802 | 751 | 745 | 735 | 706 |

The table below shows the development of the superficial hardness of the carburized layer as a function of the test temperature, using a sample that had been tempered at 300° C.

| Test temperature (° C.) | 300 | 250 | 200 | 150 | 20 |
|---|---|---|---|---|---|
| Hardness, RCH | 57 | 58 | 59 | 60 | 61 |

Example 8 (Comparative)

Similar samples were machined in a 16NiCrMo13 steel and carburized under the same conditions as those described for Example 7.

The samples were then austenitized at 825° C. and oil quenched.

Figure 7:
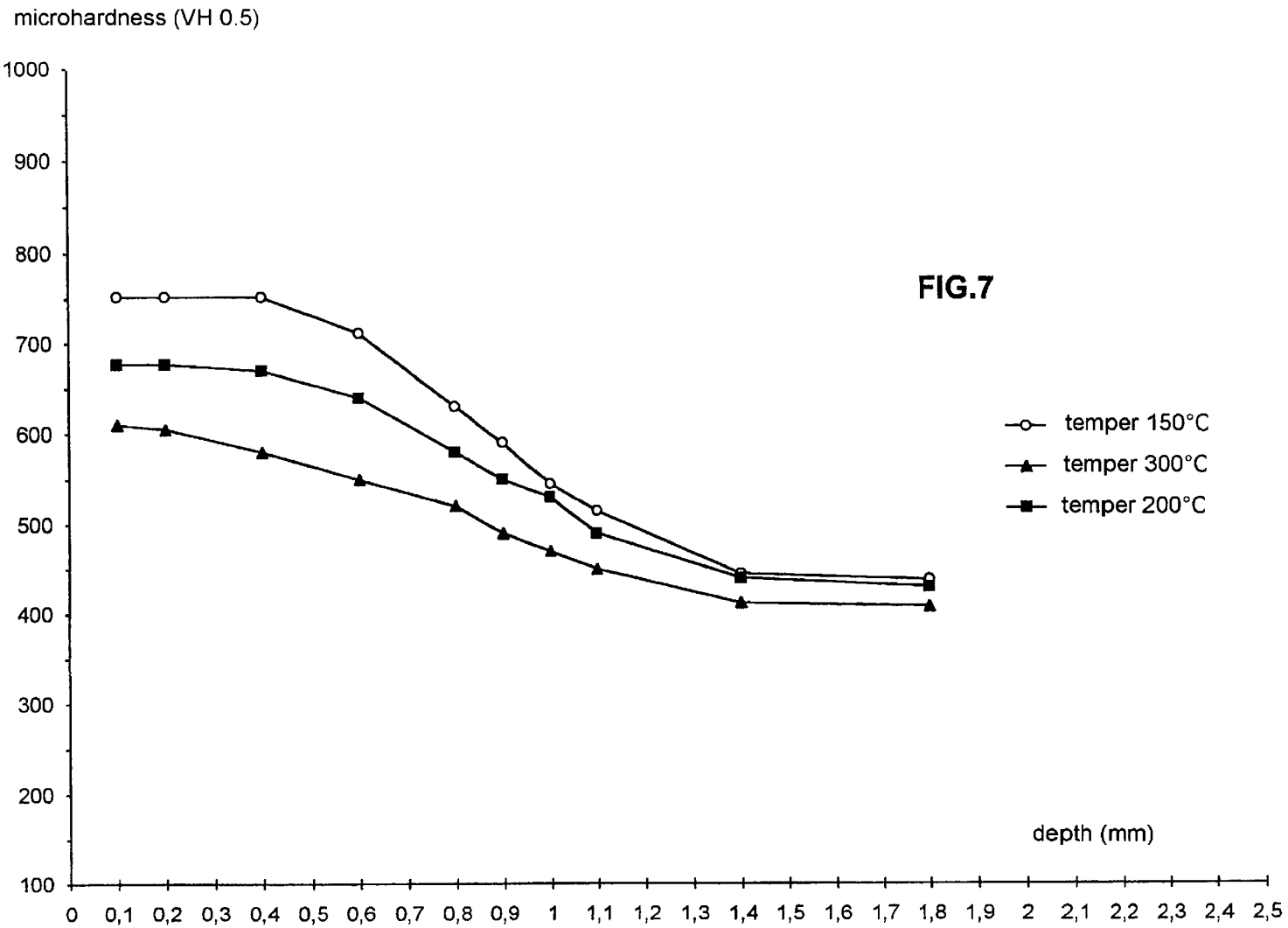
FIG. 7 shows the variation in microhardness as a function of depth for three samples, the preparation of which is described in Example 8.

Hardness measurements were carried out on polished sections to determine the hardness gradient of the carburized layer. FIG. 7 shows the results obtained for tempering temperatures of 150° C., 200° C. and 300° C.

The eight preceding examples show firstly that the steels of the invention represent an excellent compromise between the characteristics of tensile strength, impact strength and toughness and, secondly, that the carburized layer has a high tempering strength and high elevated temperature hardness values that are substantially higher than those obtained with traditional carburizing steels.

Clearly, the implementations described above are given purely by way of indication and are in no way limiting, and many modifications can readily be made by the skilled person without departing from the spirit and scope of the invention.

What is claimed is:

1. In a carburized steel composition formed from a carburizing steel composition comprising, by weight:

0.06% to 0.18% of C;

0.5% to 1.5% of Si;

0.2% to 1.5% of Cr;

1% to 3.5% of Ni;

1.1% to 3.5% of Mo;

0.37% to 2% Cu; and:

at most 1.6% of Mn; and/or at most 0.4% of V; and/or at most 4% of Co;

balanced by iron and residual impurities;

the improvement characterized by the amounts of Ni, Mn, Cu, Co, Cr, Mo and V in said carburizing steel composition, expressed by weight, satisfying the following relationships:

$$2.5 \leqq Ni+Mn+1.5Cu+0.5Co \leqq 5 \quad (1)$$

$$2.4 \leqq Cr+Mo+V \leqq 3.7 \quad (2); \text{ and}$$

characterized in that said carburized steel composition allows to maintain a superficial hardness of the carburized layer of 650 to 780 Vickers hardness at a temperature above 250° C.

2. A carburizing steel composition according to claim 1 comprising, by weight:

0.09% to 0.16% of C;

0.7% to 1.3% of Si;

0.5% to 1.2% of Cr;

2% to 3% of Ni;

1.5% to 2.5% of Mo;

0.2% to 0.7% of Mn;

0.15% to 0.35% of V;

0.3% to 1.1% of Cu; and:

at most 1.5% of Co;

balanced by iron and residual impurities;

the amounts of Ni, Mn, Cu, Co, Cr, Mo and V in said composition, expressed by weight, satisfying the following relationships:

$$2.5 \leqq Ni+Mn+1.5Cu+0.5Co \leqq 5 \quad (1)$$

$$2.4 \leqq Cr+Mo+V \leqq 3.7 \quad (2).$$

3. A carburizing steel composition according to claim 1, further comprising at most 0.020% by weight of P and at most 0.010% of weight of S.

4. A carburizing steel composition according to claim 3, further containing at most 0.1% by weight of each element Al, Ce, Ti, Zr, Ca, Nb.

5. A process for producing carburized and treated parts, comprising the following operations:

a. constituting a charge for producing a chemical composition according to any one of claims 1 to 4;

b. melting said charge in an arc furnace;

c. re-heating and thermomechanical transformation of the ingot;

d. homogenizing heat treatment of the structure and refinement of the grain;

e. carburizing; and f. final heat treatment.

6. A production process according to claim 5, in which arc furnace melting (step b)) is followed by consumable electrode remelting.

7. A production process according to claim 6, in which arc furnace melting (step b)) is carried out by reduced pressure induction.

8. A production process according to, claim 5 in which step d) comprises normalization at a temperature above the critical point $AC_3$, air cooling and softening tempering at a temperature below the critical point $AC_1$.

9. A production process according to claim 5, in which step e) is carried out using a low pressure process.

10. A production process according to claim 5, in which step f) comprises cooling to ambient temperature then re-heating to 900° C.–1050° C., oil or gas tempering, and tempering at temperatures of up to 350° C.

11. A steel part with a composition according to any one of claims 1 to 4.

12. A steel part characterized in that it is obtained by the process of claim 5.

* * * * *

UNITED STATES PATENT AND TRADEMARK OFFICE

CERTIFICATE OF CORRECTION

PATENT NO. : 6,699,333 B1
DATED : March 2, 2004
INVENTOR(S) : Philippe Dubois

It is certified that error appears in the above-identified patent and that said Letters Patent is hereby corrected as shown below:

Column 12,
Line 54, replace "0.37% to 2% Cu; and:" with -- 0.3% to 2% Cu; and: --

Signed and Sealed this

Twenty-seventh Day of July, 2004

JON W. DUDAS
*Acting Director of the United States Patent and Trademark Office*